United States Patent [19]

Furst

[11] 4,339,227

[45] Jul. 13, 1982

[54] INDUCER TIP CLEARANCE AND TIP CONTOUR

[75] Inventor: Raymond B. Furst, Northridge, Calif.

[73] Assignee: Rockwell International Corporation, El Segundo, Calif.

[21] Appl. No.: 148,106

[22] Filed: May 9, 1980

[51] Int. Cl.[3] ..... F04D 29/38

[52] U.S. Cl. ..... 415/213 C; 415/172 A; 415/DIG. 1

[58] Field of Search ..... 415/DIG. 1, 213 C, 172 A, 415/119

[56] References Cited

U.S. PATENT DOCUMENTS 3,169,694 2/1965 Borchers ..... 415/213 C
3,575,523 4/1971 Gross, Jr. ..... 415/DIG. 1
3,885,886 5/1975 Richter ..... 415/172 A
4,150,914 4/1979 Karlsson ..... 415/213 C
4,238,170 12/1980 Robideau et al. ..... 415/172 A

FOREIGN PATENT DOCUMENTS 731575 2/1943 Fed. Rep. of Germany ... 415/213 C

*Primary Examiner*—Leonard E. Smith
*Attorney, Agent, or Firm*—H. F. Hamann; Harry B. Field

[57] ABSTRACT

A pump having inducer blades configured to have a tip thickness less than about twice the clearance between the tip and the adjacent housing to prevent cavitation damage to the inducer blades.

3 Claims, 4 Drawing Figures

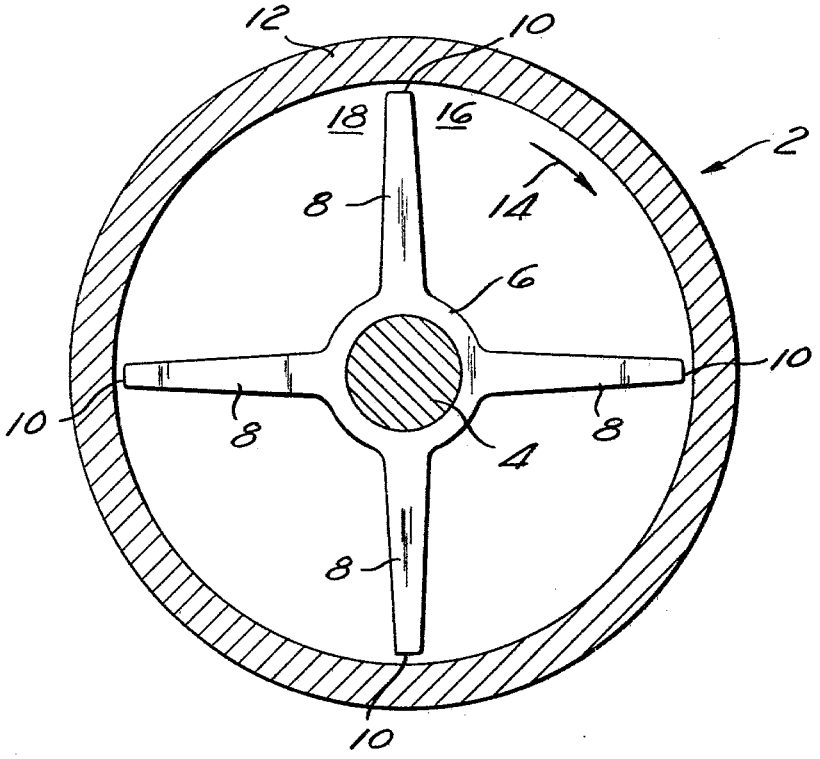
Fig. 1
Fig. 2
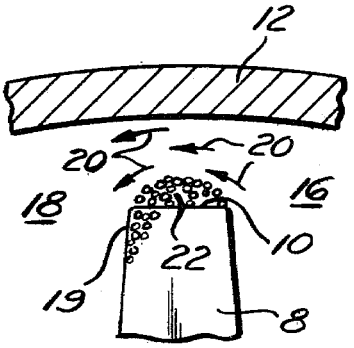
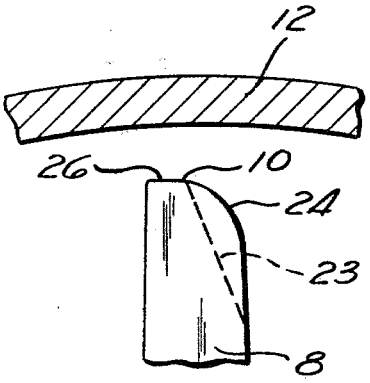
Fig. 3
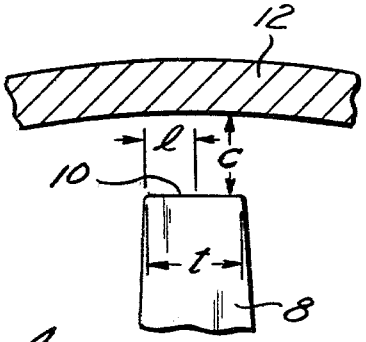
Fig. 4

INDUCER TIP CLEARANCE AND TIP CONTOUR

The Government has rights in this invention pursuant to Contract NAS8-27980 awarded by the National Aeronautics and Space Administration.

BACKGROUND OF THE INVENTION

1. Field of the Invention

This invention relates to pumps and is particularly directed to means for preventing cavitation damage to the inducer blades of a pump.

2. It is well known in the pump art that as fluid passes through a pump, it often experiences cavitation which produces bubbles in the fluid flow that subsequently collapse on the various components of the pump and cause structural damage to such components. Unfortunately, the causes of cavitations are frequently obscure and cavitations continue to be a primary factor in limiting the service life of many pumps. Several causes of cavitation have been discovered and the techniques for overcoming them are the subject of my earlier U.S. Pat. No. 3,951,565, issued Apr. 20, 1976, assigned to the present assignee. In spite of these techniques, it is found that cavitation continues to occur for other reasons and the search to detect and eliminate causes of cavitation is unending.

BRIEF SUMMARY AND OBJECTS OF THE INVENTION

These disadvantages of the prior art are overcome with the present invention and means are provided for eliminating additional causes of cavitations. The advantages of the present invention are preferably attained by configuring the inducer blades so that the thickness of the blade tip is less than about twice the clearance between the tip and the adjacent housing.

Accordingly, it is an object of the present invention to provide improved pumps.

Another object of the present invention is to provide means for reducing cavitation damage to pumps.

A further object of the present invention is to provide a pump having inducer blades configured so that the thickness of the blade tip is less than about twice the clearance between the tip and the adjacent housing.

These and other objects and features of the present invention will be apparent from the following detailed description, taken with reference to the accompanying drawing.

BRIEF DESCRIPTION OF THE DRAWINGS

FIG. 1 is a diagrammatic representation of a pump having an inducer blade as taught by the prior art.

FIG. 2 is an enlarged detail showing the tip of the prior art inducer blade of FIG. 1.

FIG. 3 is a view, similar to that of FIG. 2, showing the tip of an impeller blade embodying the present invention.

FIG. 4 is a view, similar to that of FIG. 2, showing the relationship between tip clearance and blade thickness.

DETAILED DESCRIPTION OF THE PREFERRED EMBODIMENT in that form of the present invention chosen for purposes of illustration, FIG. 1 shows a pump, indicated generally at 2, having a drive shaft 4 which rotates an inducer 6 that is formed with a plurality of inducer blades 8, each having a tip 10 moving in proximity to a housing 12. As the inducer 6 rotates in the direction indicated by arrow 14, each of the inducer blades 8 pushes through the fluid within the housing 12. This creates a high pressure region 16 ahead of the blade 8, and a low pressure region 18 behind the blade 8. In addition, the flow of fluid between blade tip 10 and the adjacent housing 12 tends to create a high velocity jet, flowing in the direction indicated by arrows 20, and a low pressure area 22 is created between the jet 20 and the blade tip 10.

If the pressure in low pressure areas 18 and 22 falls below the vapor pressure of the fluid, as is often the case, bubbles are formed which will be carried with the flow and, if they encounter the surface of a pump component, the bubbles will collapse, causing substantial damage to the pump component. This condition is called "cavitation". Since the blade 8 is moving away from low pressure area 18, cavitation occurring in this region will be carried with the flow toward the pressure side of a subsequent blade. Damage due to this type of cavitation can be avoided as taught in my aforementioned U.S. Pat. No. 3,951,565.

Cavitation occurring in low pressure area 22 can collapse and cause damage on the suction side 19 of the inducer blade 8 adjacent tip 10. From fluid mechanics, it can be shown as seen in FIG. 4 that the pressure tending to cause collapse of the cavitation bubbles is $$P = \frac{0.17\,(t - l)}{2c} \times 0.672\,H \qquad \text{I}$$

when t—tip thickness of the inducer blade l=chord length necessary for collapse of the bubbles c=clearance between blade tip 10 and housing 12

H=head difference across blade 8

The likelihood of the bubbles collapsing on the inducer blade 8 increases as the pressure P from Equation I approaches the maximum possible value of 0.328H. Thus, cavitation damage will most likely occur where:

$$\frac{0.17\,(t - l)}{2c} \times 0.672H = 0.328\,H \qquad \text{II}$$

$$0.17\,(t - l) = \frac{0.328}{0.672} \times 2c \qquad \text{III}$$

$$t - l = 5.74c$$

Accordingly, it will be seen that the thickness of blade tip 10 should not be more than about twice the clearance between the blade tip 10 and the adjacent housing 12 in order to assure freedom from cavitation damage. This thickness limitation can be achieved by chamfering, as indicated by dashed line 23 in FIG. 3, or by rounding the pressure surface, as seen at 24 in FIG. 3, so that the portion 26 of tip 10 facing the adjacent housing 12 has a thickness of less than about twice the distance to the housing 12.

Obviously, numerous variations and modifications can be made without departing from the invention. Accordingly, it should be clearly understood that the form of the present invention described above and shown in the accompanying drawings is illustrative only and is not intended to limit the scope of the present invention.

What is claimed and desired to be secured by Letters Patent of the United States is:

1. A pump comprising:

a housing;

an inducer rotatable within said housing and formed with a plurality of blades each having a tip thickness less than about twice the clearance between said tip and said housing.

2. The pump of claim 1 wherein said inducer blades are chamfered to cause the surface of the inducer blade tip facing said housing to have a thickness less than about twice the clearance between said surface and said housing.

3. The pump of claim 1 wherein the pressure side of the tip of said inducer blade is curved so that the surface of the inducer blade tip facing said housing has a thickness less than about twice the clearance between said surface and said housing.

* * * * *